US005293723A

United States Patent [19]

Slessor

[11] Patent Number: 5,293,723

[45] Date of Patent: Mar. 15, 1994

[54] SYNTHETIC DOOR FRAME

[75] Inventor: Ted Slessor, Alliston, Canada

[73] Assignee: Canadian Heritage Window Mfg. Inc., Barrie, Canada

[21] Appl. No.: 918,620

[22] Filed: Jul. 27, 1992

[51] Int. Cl.[5] ..... E04B 1/04

[52] U.S. Cl. ..... 52/213; 52/204.1; 52/656.4; 52/717.01; 49/504; 49/380; 49/382

[58] Field of Search ..... 52/204.1, 210, 213, 52/656.2, 656.4, 717.1; 49/504, 400 DIG. 2, 380, 382; 5/211, 215

[56] References Cited

U.S. PATENT DOCUMENTS

| | | | |
|---|---|---|---|
| 1,266,547 | 5/1918 | Baxter | 52/717.01 X |
| 1,606,780 | 11/1926 | Zahner et al. | 49/504 X |
| 2,309,452 | 1/1943 | Hasenburger et al. | 49/504 |
| 2,850,126 | 9/1958 | Furney | 49/400 |
| 3,068,970 | 12/1962 | Neal | 49/504 X |
| 3,287,856 | 11/1966 | Passovoy | 49/504 |
| 3,310,920 | 3/1967 | Bell et al. | 49/504 X |
| 3,354,586 | 11/1967 | Bester | 52/213 |
| 3,469,350 | 9/1969 | Lange | 52/213 |
| 3,654,734 | 4/1972 | Lehman | 52/213 X |
| 4,005,558 | 2/1977 | Barrison | 52/213 |
| 4,281,481 | 8/1981 | Wendt | 52/213 X |
| 4,441,277 | 4/1984 | Naylor | 49/382 X |
| 4,505,080 | 3/1985 | Sailor | 52/213 X |
| 4,531,337 | 7/1985 | Holdman | 52/213 X |
| 4,694,612 | 9/1987 | Pruder et al. | 49/524 X |
| 5,038,538 | 8/1991 | Rozon | 52/213 |

*Primary Examiner*—Carl D. Friedman
*Assistant Examiner*—Robert Canfield

[57] ABSTRACT

A synthetic door frame includes an interior channel into which mounting members are fitted for securing the synthetic door frame to a building. The synthetic door frame further includes a cap which fits over the channel and covers the frame mounting members.

10 Claims, 5 Drawing Sheets

10b
10a
13
11
8
7
9
23
39
39
37
47
49
45
46
25

SYNTHETIC DOOR FRAME

FIELD OF THE INVENTION

The present invention relates to a synthetic door frame.

BACKGROUND OF THE INVENTION

Conventional door frames have a wood construction. Some presently available wooden door frames may be treated with protective covering material such as a thin layer of plastic.

To date, there is nothing commercially available in the way of a synthesized door frame, e.g. a door frame having an all vinyl or similar plastic construction.

In order to mount a conventional wooden door frame, securing members, e.g. screws, are threaded through the frame into the surrounding building wall. Further steps are then taken to patch the door frame for purposes of hiding the mounting screws.

For new building construction, doors are generally sold already mounted in a surrounding door frame. For installation of the combination door and door frame, the frame is levelled and then mounted with the door held open. The reason the door must be held open is to gain access to the interior of the frame immediately surrounding the door where the screws are located in the frame. This method of door mounting is awkward, labour intensive and cost inefficient.

SUMMARY OF THE INVENTION

The present invention provides a synthesized, preferably vinyl, door frame which is much simpler and easier to mount than existing door frames. More particularly, the synthesized door frame of the present invention includes at least one interior channel where the mounting screws are located and further includes a cap which fits over the channel and hides the mounting screws.

According to a preferred aspect of the present invention, the synthesized door frame includes first and second interior channels with a covering cap for each of the channels. The second interior channel may provide an area for an initial hanging of the frame with the frame levelled and the door in a closed position. With the door closed, it is much easier to maintain the level position of the frame.

After the door has been initially hung at the second channel, the door is opened and the final hanging of the door is completed by fitting mounting screws in the first channel immediately around the door perimeter. The covering caps are then fitted over both channels to hide all of the mounting screws.

BRIEF DESCRIPTION OF THE DRAWINGS

The above, as well as other advantages and features of the present invention, will be described in greater detail according to the preferred embodiments of the present invention in which.

DETAILED DESCRIPTION OF THE PREFERRED EMBODIMENTS

Figure 1:
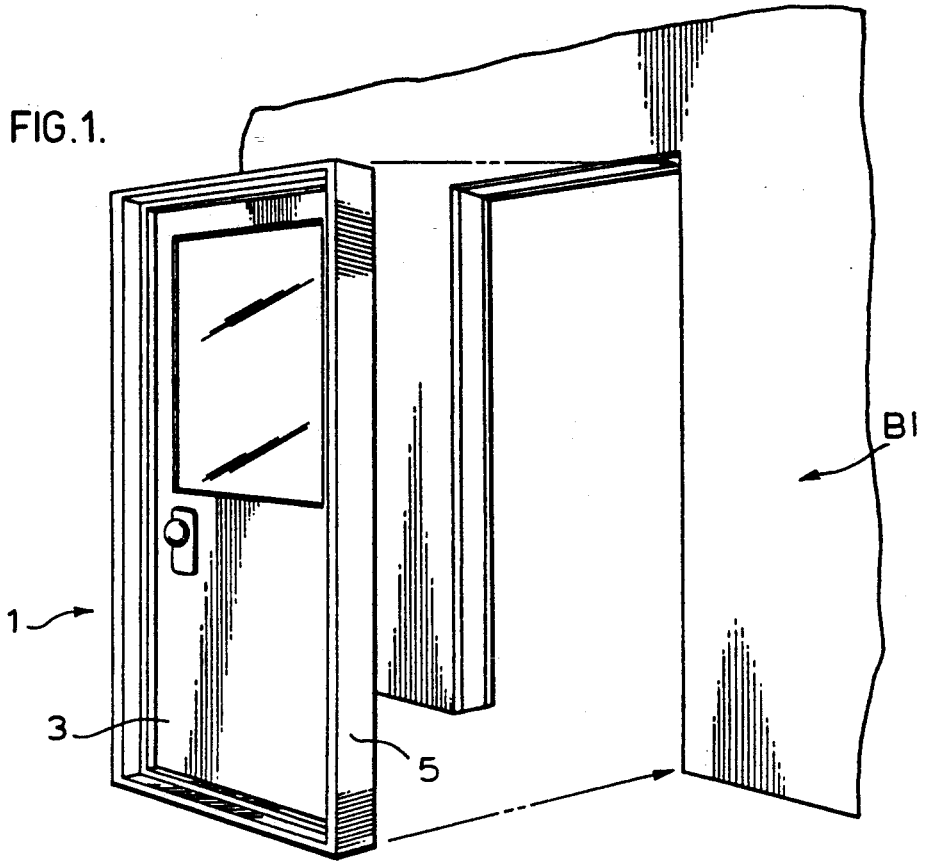
FIG. 1 is a perspective view of a door and frame combination ready for fitting in a building construction according to a preferred embodiment of the present invention.

FIG. 1 shows a door with synthesized frame assembly generally indicated at 1 ready for installation in a building BD. The assembly 1 comprises the door 3 and the synthetic frame 5. The door itself preferably has a metal construction although other materials can be used in the door.

The term synthesized used in association with frame relates to any man made shape formable material. In the preferred embodiment the frame has a vinyl or similar thermosettable plastic material construction.

Figure 2:
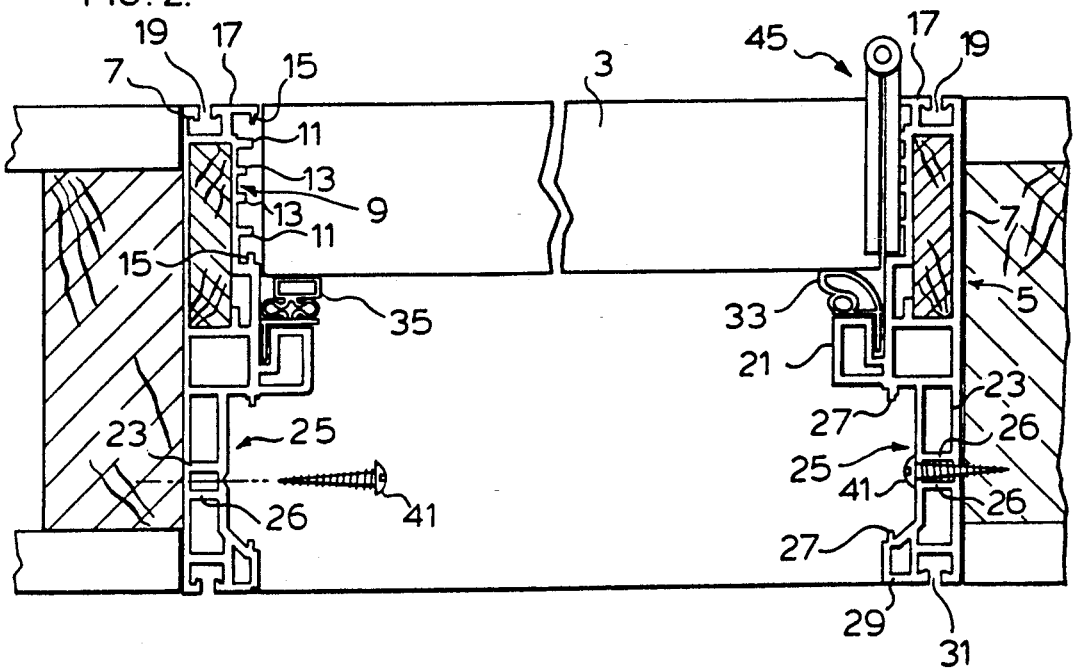
FIG. 2 is a sectional view looking down into the door and frame assembly during its initial installation in the building construction of FIG. 1.
Figure 3:
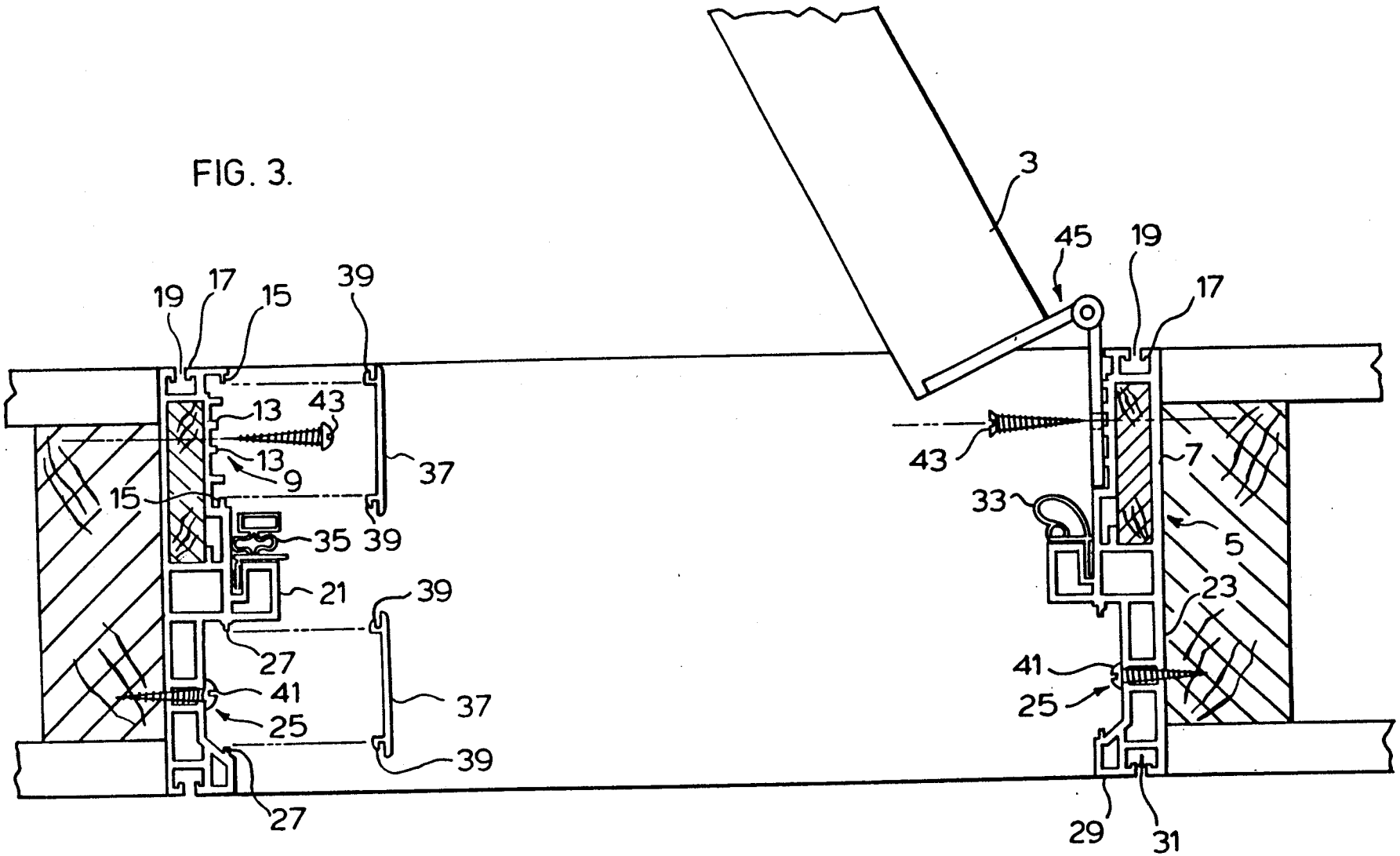
FIG. 3 is a further sectional view similar to FIG. 2 showing final mounting of the door and frame assembly into the building construction.

The details of synthesized frame 5 are best seen in FIGS. 2 and 3 of the drawings. The frame comprises first and second frame portions 7 and 23 which are divided by a door stop 21. The frame portions and door stop comprise a single integral construction.

The first frame portion 7 is in all embodiments used as a door mounting region for the door 3. The second frame portion 23 may be used to provide an initial mounting of the frame to the building, after the frame and door have been set to a level position. This initial mounting is achieved with the door held in its closed position as shown in FIG. 2 of the drawings and then the final mounting or securing of the frame is accomplished at the first frame portion with the door in an opened position as shown in FIG. 3. However, when the door is moved to the open position, the level positioning of the frame and door is maintained by the initial mounting at the second frame portion 23.

In terms of a more detailed description, each of the frame portions includes an interior channel to opposite sides of the frame where a channel generally indicated at 9 is provided in frame portion 7 and a channel generally indicated at 25 is provided in frame portion 23. After installation, the entirety of channel 25 is covered by a snap cap 37 having a pair of interior lips 39 which lock on to lips 27 to opposite sides of channel 25.

Channel 9 in frame portion 7 is over much of its length, i.e. at areas other than the hinges and the striker plate, covered by the identical cap 37. In this case the cap lips 39 lock onto inwardly extending lips 15 provided at the outer edges of channel 9. Provided interiorly of channel 9 are two sets of ribs including a first set of taller ribs 11 and a second set of ribs 13 which are shorter than the ribs 11.

The first frame portion 7 includes an outer facing 17 having an undercut channel 19. The second frame portion 23 includes an outer facing 29 having an undercut channel 31. Channel 31 is identical to channel 19 and therefore these two channels are capable of receiving the same type of trim accessories, some of which are described below.

Figure 6:
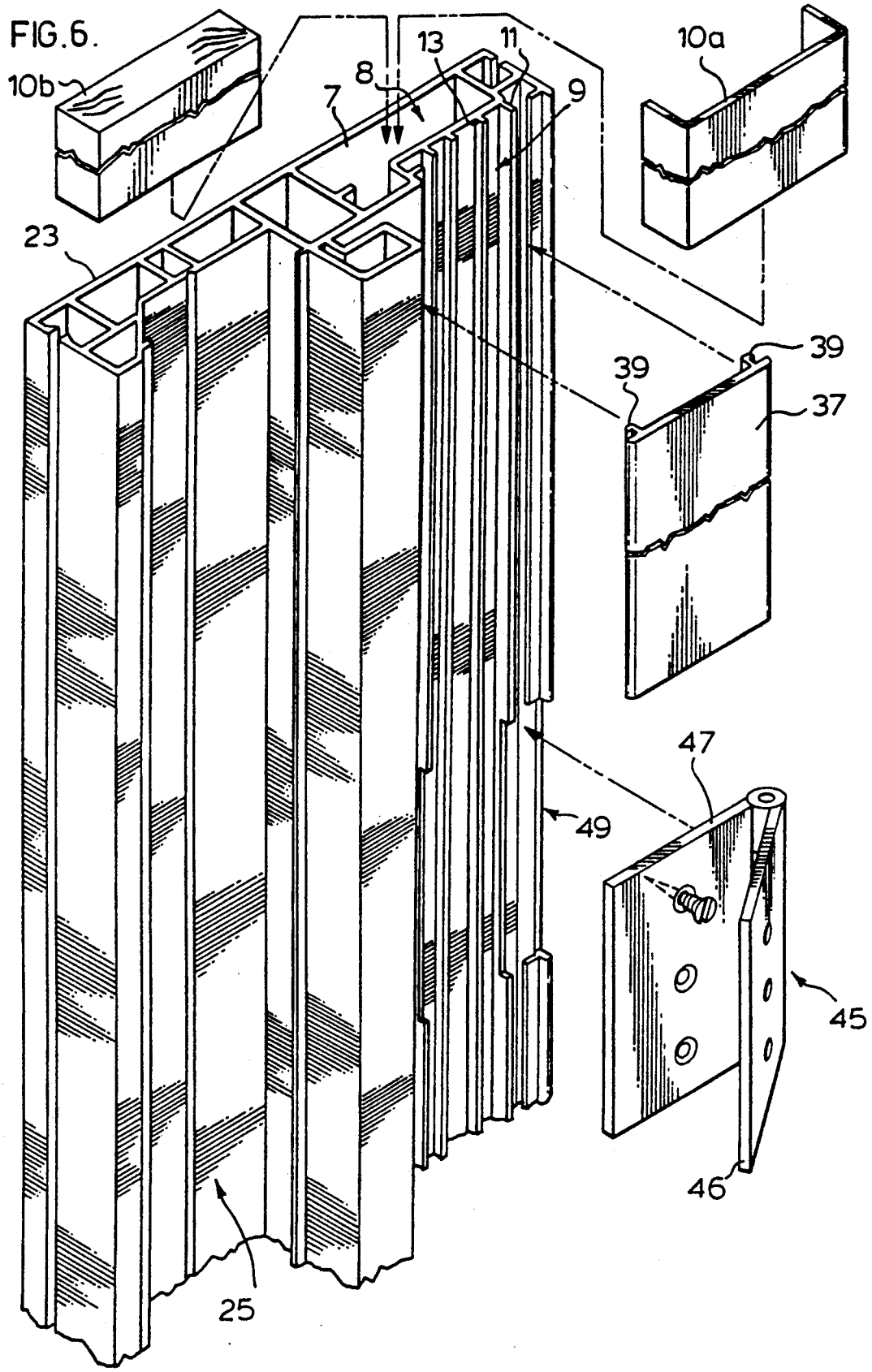
FIG. 6 is an exploded perspective view of one side of a door frame and hinge mount according to a preferred embodiment of the present invention

Before going into the actual mounting details, further reference is had to FIG. 6 of the drawings showing the hinge mounting area in the frame and further showing safety features of the frame. In particular, the first frame portion 7 includes a hollow interior region generally indicated at 8. This hollow region is designed to receive different types of reinforcements for the synthesized frame. In one embodiment where the door requires a fire safety rating, a length of channel shaped steel plate 10*a* is inserted in the hollow 8 which prevents the frame from buckling when subjected to intense heat as would occur in the case of a fire. If the door does not material 10*b* is used as an alternative stiffener which again fits within the hollow interior 8 of frame portion 7.

FIGS. 2 and 3 of the drawings show that the door 3 is mounted to the frame 5 by means of a hinge generally indicated at 45. Again, referring to FIG. 6 of the drawings, hinge 45 includes a door mounting leg 46 and a frame mounting leg 47. The first frame portion 7 of the door frame is cut away as indicated at 49 to remove the interior edge of the front facing and to additionally cut down the depth of the two taller ribs 11 in the channel 9 of frame portion 7. The ribs 11 are cut back so that they are the same height as the shorter interior ribs 13 which allows a flush mounting of leg 47 on hinge 45 across the door frame. The cap 37 is then placed to opposite sides of the hinge, i.e. above and below the hinge, which gives the hinge a mortise like appearance as if it was built directly into the frame flush with the channel cap.

Although not shown, frame portion 7 is additionally fitted with a striker plate and the frame portion will again be cut away to receive the striker plate. However, because the striker plate is of thinner material than the hinge, the striker plate will seat on ribs 11 which do not need to be cut back and which locate the striker plate at a level once again flush with cap 37 to opposite sides of the striker plate. Accordingly, the striker plate, like the hinges, has a mortised appearance on the door frame.

The installation steps for mounting door and frame assembly 1 include an initial levelling of the frame with the door in its closed position. Once the frame has been levelled and keeping the door closed as shown in FIG. 2 of the drawings, a first set of mounting screws 41 are screwed through the frame portion 23 into the surrounding building material. These screws 41 are located in the channel 25 of the frame portion 23. This frame portion is provided with internal ribs 26 through which the screw are threaded providing a very positive engagement for the screws and stiffening the frame portion in this area against inward collapsing as shown in FIG. 2 of the drawings.

After the frame portion has been initially secured and hung by screws 41, the door can then be swung open with the frame holding its level position and allowing access to the channel 9 in the first frame portion for insertion of further screws 43. These screws are fitted between the two shorter ribs 13 which provide a guide for the screws. Screws 43 also fit through the reinforcing steel plate or wood core in the hollow of the first frame portion into the building material outside of the frame. Screws 43 therefore provide a final stabilized mounting of the frame.

After the frame has been installed as described immediately above, the channel caps 37 are snapped into position. These channel caps although easily installed require a substantial effort to remove to guard against tampering and unauthorized access by removing the screws hidden by the caps. Furthermore, the screws in frame portion 7 are not accessible once the door is closed.

From an aesthetic standpoint, caps 37 are extremely beneficial in that they hide the door mounting screws eliminating the necessity to patch the door as found with conventional wooden door frames.

One of the very beneficial features provided by frame 5 is that it is reversible for use in supporting either an outswinging or an inswinging door. Both of these terms are used relative to the outside of the building i.e. swing out or swing in relative to the building exterior.

Figure 4:
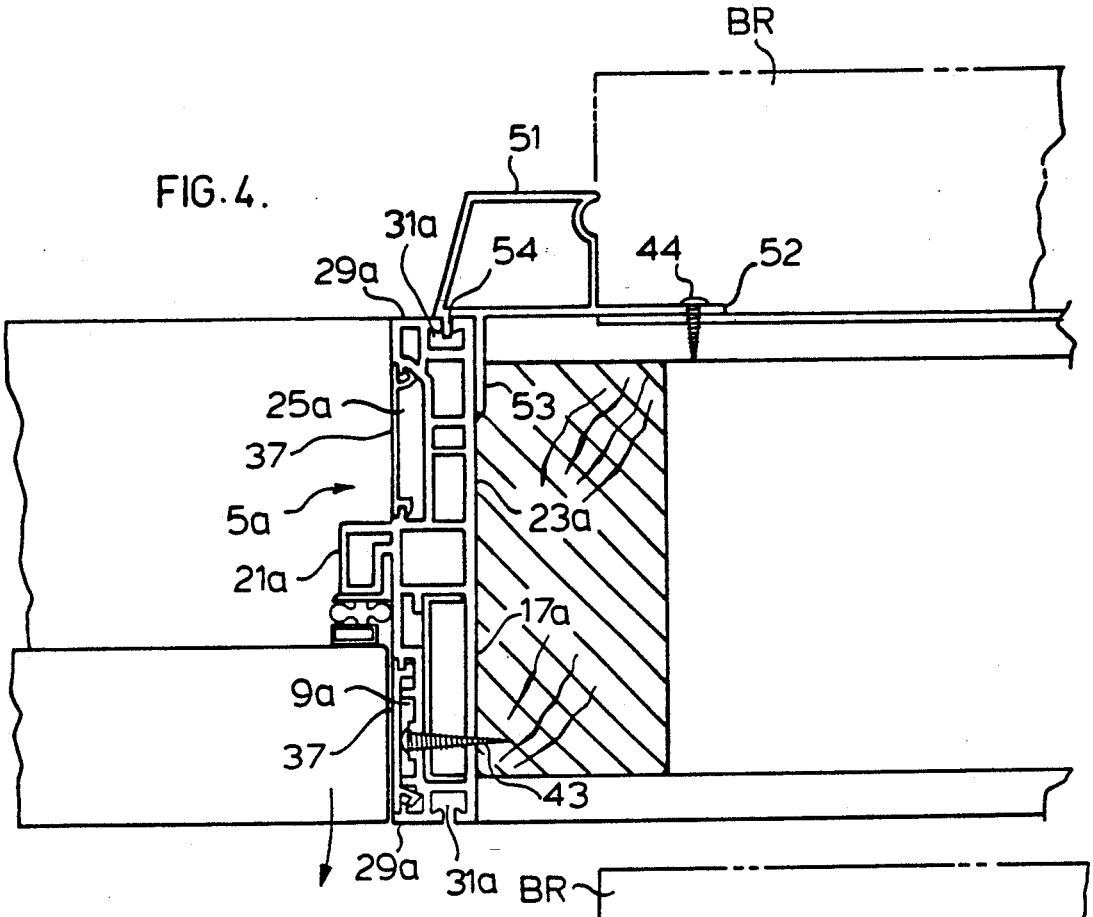
FIG. 4 is a sectional view looking down through an installed door frame supporting an inswinging door according to a preferred embodiment of the present invention.
Figure 5:
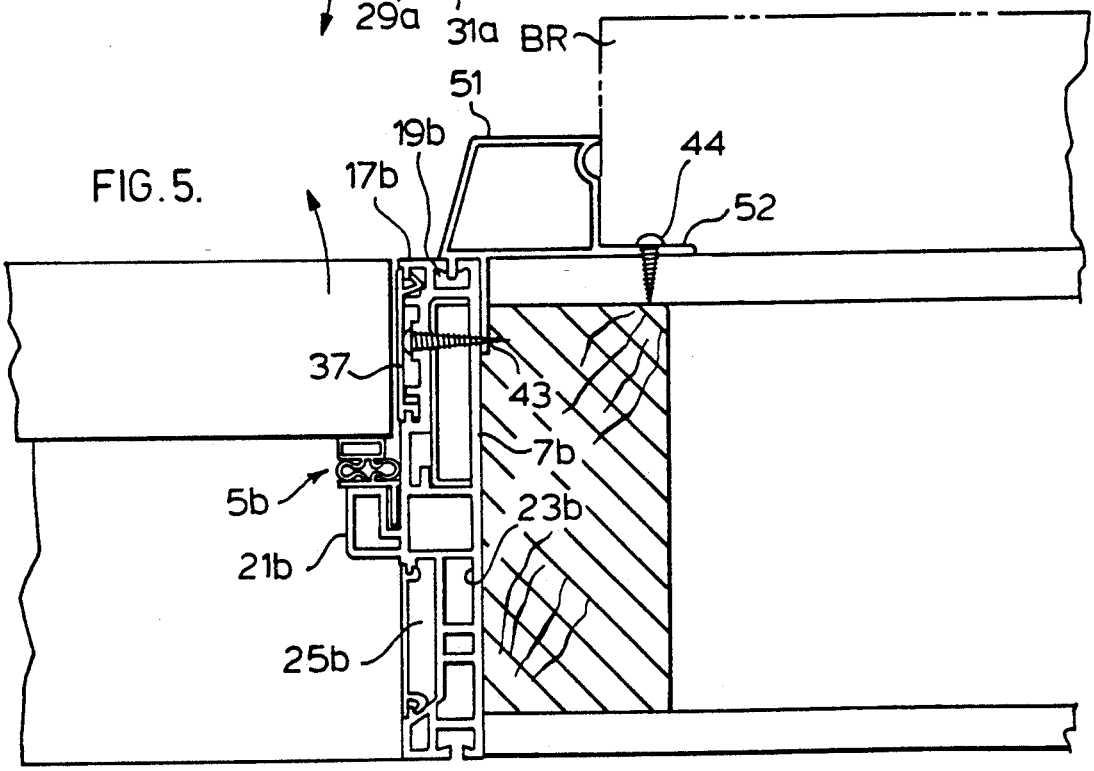
FIG. 5 is a view similar to FIG. 4 but showing the installation of an outswinging door according to a preferred embodiment of the present invention.

FIGS. 4 and 5 of the drawing show slightly modified door frames 5*a* and 5*b*. Each of these frames is mounted in a building having an exterior brick facing BR which is secured to the building after mounting the frame. The door supported by frame 5*a* in FIG. 4 is an inswinging door and the door supported by frame 5*b* in FIG. 5 is an outswing door.

Door frame 5*a* includes first and second frame portions 7*a* and 23*a*. Provided between the frame portions is a door stop 21*a*.

In this particular arrangement, the channel region 25*a* of frame portion 23*a* is not necessarily used in the initial securing of the frame. Rather a facia member 51 having a nailing fin 52 is provided to the outer edge of the frame portion 23*a*. When the frame is levelled, mounting screws 44 are screwed through the nailing fin 52 into the building to hold the level position of the frame. Again, this is done with the door in a closed position. In order to provide a final securing of the door, it is opened and screws 43 are inserted in the channel 9*a* of the first frame portion 7*a*. The cap 37 identical to the earlier cap is then fitted over channel 9*a*.

In this particular arrangement, although not necessary, additional mounting screws may still be mounted in the channel 25*a* of the second frame portion 23*a* and hidden by cap 37.

The brick facia member 51 includes a small leg 54 insertable in the channel 31*a* of the forward facing 29*a* on the door frame. It further includes a second leg 53 which sets to the outside of and is secured to the frame as, for example, by stapling to the frame. The brick facing is seated over nailing fin 52 after screws 44 had been threaded into place.

In FIG. 5, door frame 5*b* is similar to frame 5*a* but reversed in its direction of installation. This again is a very beneficial feature of the vinyl frame of the present invention in that it is reversible according to whether or not one wishes to mount an inswinging or an outswinging door.

FIG. 5*b* shows a modification of the present invention where the initial as well as the final door hanging is all done at the same side of the frame. More particularly, with the set up of frame 5*b*, frame portion 7*b* faces to the outside of the building and is fitted with the brick facia member 51 having the nailing fin 52. Again, this nailing fin is used to receive screws 44 for setting up and holding a squared or level position for the door frame with the door in its closed position. Once the level position has been established and held by the nailing fin, the door is opened and final mounting screws 43 are secured in the channel 9*a* through the frame reinforcing member and into the building itself. Screws 43 are then covered by cap 37. Additional screws may be fitted into the channel 25*b* of the frame portion 23*b* simply to insure that this frame portion does not lift away from the building.

In all mounting installations, a sealing strip is provided on the door stop as shown. The sealing strip on the door stop away from the hinge side of the door further includes a magnetic strip to provide a positive door closure. As earlier described, the door may have a metal construction or at least a metal strip which is attracted to the magnetic sealing strip on the door frame. The sealing strip arrangement, except for its orientation, remains the same regardless of the direction in which the frame is installed relative to the building as can be seen, for example, in comparing FIGS. 4 and 5.

Figure 7:
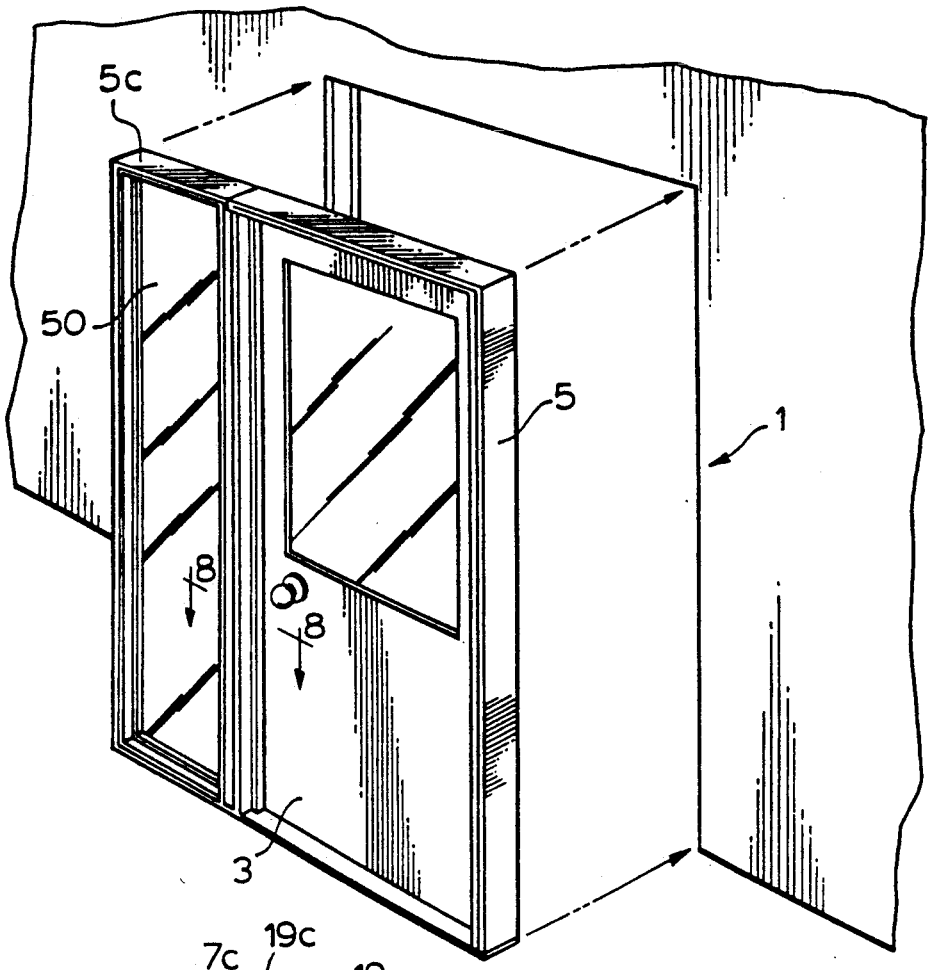
FIG. 7 is a perspective view of a combination door, door frame and side window assembly ready for installation into a building construction according to a preferred embodiment of the present invention.
Figure 8:
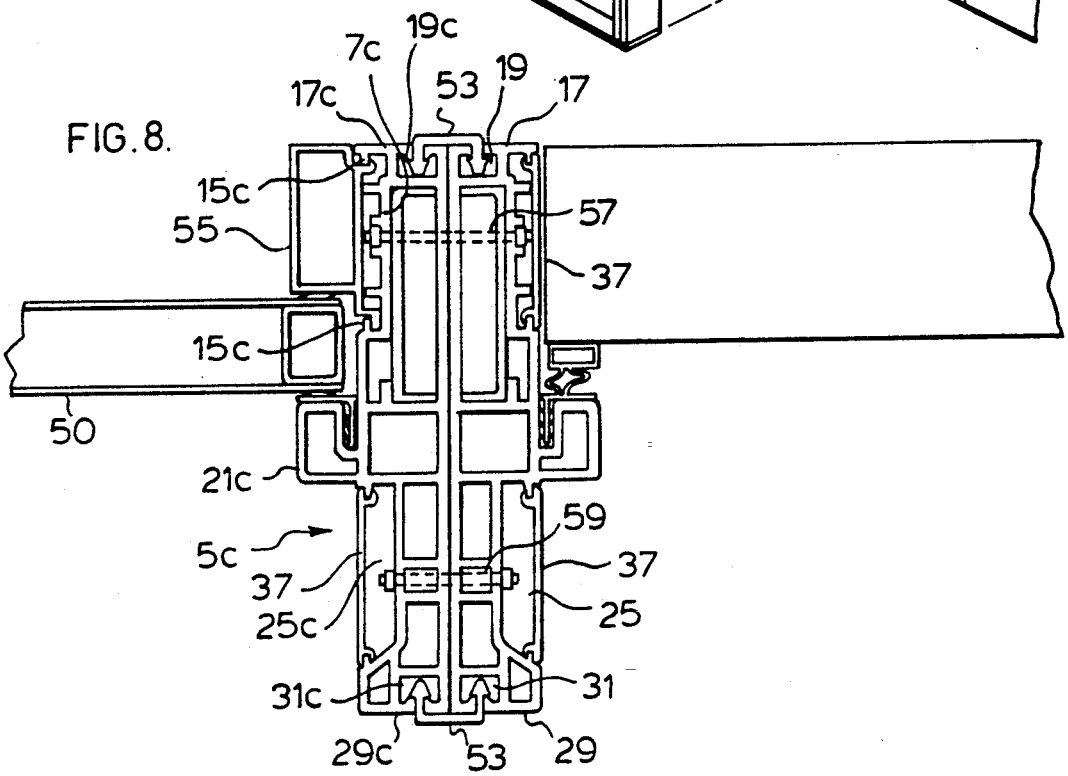
FIG. 8 is a sectional view along the lines 8-8 of FIG. 7.

FIGS. 7 and 8 show a further feature of the present invention in which assembly 1, including door 3 and frame 5, are attached to a further frame 5*c* carrying a side window 50 for installation in a building. In this particular arrangement, the securing is provided at the outer sides of frame 5 and frame 5*c* respectively. As can be seen FIG. 8 of the drawings, these two frames are identical in construction although frame 5*c* is narrower than frame 5 and the method of securing at both frames is the same as that described above.

In FIG. 8, it will be seen that the first frame portion 7*c* of frame 5*c* includes an outer facing 17*c* with an undercut channel 19*c*. The second frame portion 23*c* includes a facing portion 29*c* with an undercut channel 31*c*. Facing portion 29*c* is located to the inside of the building.

Connecting pieces 53 fit into the undercut channels at the aligned facings of the two frames 5 and 5*c* to connect the frames with one another. Additionally provided are mechanical fasteners 57 and 59 in the first and second channel regions respectively of the two frames. Mechanical connectors 59 are then covered by caps 37 as shown. The mechanical connectors 57 are covered by a cap 37 on frame 5 and by a combination cap and blocking member 55 on frame 5*c*.

Frame 5*c* includes a stop 21*c* which, rather than being a door stop, provides a window edge stop or guide for window 50. The window is therefore trapped in position between stop 21*c* and the capping member 55 which includes lip 56 that interlocks with the lips 15*c* on the frame portion 7*c* of the frame 5*c*. This same securing arrangement is provided at the other side of frame 5*c* for holding the opposite edge of window 50.

With the set up as described immediately above, the door and side window combination is mounted as a single unit to the building.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A door frame with a resin material construction and having a first channel providing a mounting region for a final mounting of said frame to a surrounding support and a second channel providing a hanging region for an initial hanging of said frame prior to the final mounting, said first channel being covered by a first channel cap defining an outer door edge border for a door to be fitted in said frame, said second channel being covered by a second channel cap, said first and second channels being separated from one another by a door stop, said door stop being at right angles to said first channel cap.

2. A door frame as claimed in claim 1, wherein said first channel is fitted with a reinforcing member more rigid than said resin material and covered by said first cap.

3. A door frame as claimed in claim 2, wherein said reinforcing member has a metallic construction.

4. A door frame as claimed in claim 2, wherein said reinforcing member has a hardwood construction.

5. A door frame as claimed inlaid 1, wherein said first and second caps snap back into said first and second channels and said first and second caps are at least substantially identical in construction.

6. A door frame as claimed in claim 1, wherein said second channel comprises a channel base, an interior channel wall parallel and spaced from said channel base and spaced apart stiffening ribs extending between said channel base and said channel wall, said stiffening ribs providing a mounting member guide in said second channel.

7. A door frame and door combination said door frame having a resin material construction, said door having an outside edge and side faces to opposite sides of said outside edge, said door frame having a first channel which provides a mounting region for a final mounting of said frame to a surrounding support for said frame, and a second channel providing a hanging region for an initial hanging of said frame with said door closed in said frame where said outside edge of said door aligns with said first channel of said frame, said fist channel being covered by a first channel cap forming a door edge border for the door when closed, said second channel being covered by a second channel cap and said first and second channels being separated by a door stop, said door stop being at right angles to said first and second channel caps and abutting one of the side faces of said door when said door is closed in said frame.

8. A door frame as claimed in claim 7, wherein said frame is formed by first and second said by side integral frame portions separated by said door stop, said first channel being provided n said first fame portion and said second channel being provided in said second frame portion, said first and second frame portions having identical outer fascia regions, each outer fascia region including an accessory receiving opening.

9. A resin material door frame having a channel providing a region for a final mounting of said frame to a surrounding support for said frame, and said frame including a hanging region for an initial hanging of said frame prior to the final mounting, said channel being covered by a channel cap defining an outer door edge border for a door to be fitted in said frame, and a door stop, said door stop being adjacent and at right angles to said channel cap, said hanging region for initial hanging of said frame being located remotely of said channel on said frame.

10. A door frame as claimed in claim 9, wherein said hanging region comprises a nailing fin on an outside face of said frame.

* * * * *